US005985210A

United States Patent [19]

Leppänen

[11] Patent Number: 5,985,210

[45] Date of Patent: Nov. 16, 1999

[54] NITRIDING STEEL

[75] Inventor: Rainer R. Leppänen, Hällefors, Sweden

[73] Assignee: Ovako Steel, Hallefors, Sweden

[21] Appl. No.: 09/069,174

[22] Filed: Apr. 29, 1998

[30] Foreign Application Priority Data

Apr. 29, 1997 [SE] Sweden ..... 9701593

[51] Int. Cl.[6] ..... C22C 38/22

[52] U.S. Cl. ..... 420/105

[58] Field of Search ..... 420/105; 148/318

[56] References Cited

U.S. PATENT DOCUMENTS 4,089,679 5/1978 Zecman ..... 420/105

FOREIGN PATENT DOCUMENTS 3 55145155 11/1980 Japan ..... 148/318

*Primary Examiner*—Deborah Yee

*Attorney, Agent, or Firm*—Burns, Doane, Swecker & Mathis, L.L.P.

[57] ABSTRACT

A nitriding steel, especially for the manufacture of structural components subjected to wear, comprising, in % by weight:

C 0.10–0.20

Si ≦0.50

Mn 0.65–1.20

Cr 1.50–4.00

Mo 0.40–0.70

Al ≦0.50 remainder Fe+normal impurities.

7 Claims, 2 Drawing Sheets

NITRIDING STEEL

BACKGROUND OF THE INVENTION

The present invention relates to a nitriding steel, especially for the manufacture of structural components subjected to wear.

JP 50037629-A provides a previously known high-strength steel having the analysis, in % by weight:

C 0.1–0.25
Si ≦0.4
Mn 0.3–11.0
Cr 0.5–2
Mo 0.07–0.23
Al 0.5–1.2
remainder Fe+normal impurities.

The above steel gives good results in the provided use, but there is still the need for a steel with improved manufacturing, working, and nitriding properties in order for the components manufactured from said steel to exhibit improved characteristics.

JP 63062859, discloses a machine steel with good strength properties suitable for the manufacture of, e.g., gears, shafts and sliding elements, which rotate or slide under high pressure. This steel has the analysis, in % by weight:

C 0.1–0.3
Si ≦1.5
Mn ≦0.60
Cr 0.5–2.5
Mo 0.3–1.0
remainder Fe+normal impurities.

This steel is not optimal either, and there is especially a need for improving the nitriding properties and the hardening capacity of such steels.

OBJECTS AND SUMMARY OF THE INVENTION

It is an object of this invention to avoid or alleviate the problems of the prior art.

It is further an object of this invention to provide a nitriding steel with improved functional, working and manufacturing characteristics compared to known nitriding steels.

C 0.10–0.20
Si ≦0.50
Mn 0.65–1.20
Cr 1.50–4.00
Mo 0.40–0.70
Al ≦0.50
remainder Fe+normal impurities.

DETAILED DESCRIPTION OF THE PREFERRED EMBODIMENTS OF THE INVENTION

One steel of the present invention comprises, in % by weight:

C 0.10–0.20
Si ≦0.50
Mn 0.65–1.20
Cr 1.50–4.00
Mo 0.40–0.70
Al ≦0.50
remainder Fe+normal impurities.

According to a further development of the steel according to the presently claimed invention, the steel comprises 0.10–0.50% by weight of Al.

According to a preferred embodiment of the presently claimed invention, the steel has the following analysis, in % by weight:

C 0.15–0.20
Si 0.20–0.40
Mn 0.75–1.00
Cr 1.75–2.00
Mo 0.50–0.60
Al 0.010–0.10
remainder Fe+normal impurities.

According to an alternative preferred embodiment of the presently claimed invention, the steel has the following analysis, in % by weight:

C 0.10–0.18
Si 0.20–0.40
Mn 0.75–1.00
Cr 2.50–4.00
Mo 0.50–0.65
Al 0.10–0.35
remainder Fe+normal impurities.

With the steel according to the presently claimed invention, compared to known nitriding steels, a substantially improved nitriding depth is achieved, as well as a substantially improved workability and improved manufacturing properties.

In contrast to the steel of JP 50037629, the nitriding steel according to the presently claimed invention has higher Cr and Mo contents, resulting in a better nitriding ability as well as a better hardening capacity. Further, the lower Al content gives improved manufacturing properties.

Unlike the steel of JP 63062859, the nitriding steel according to the presently claimed invention has a inter alia higher manganese content, which results in a better hardening capacity. The more narrow Mo range gives a better repeatability of the properties of the steel. In contrast to the steel according to the presently claimed invention, the steel of JP 63062859 does not contain any added amounts of Al, which results in inferior nitriding properties, inferior purity and inferior grain size.

The steel according to the presently claimed invention can be manufactured with known methods. The adaptation of which allows control of the concentrations of primary, secondary and residual alloying elements according to the presently claimed invention lies within the skill of one of ordinary skill in the art in the manufacture of nitriding steel.

Figure 1:
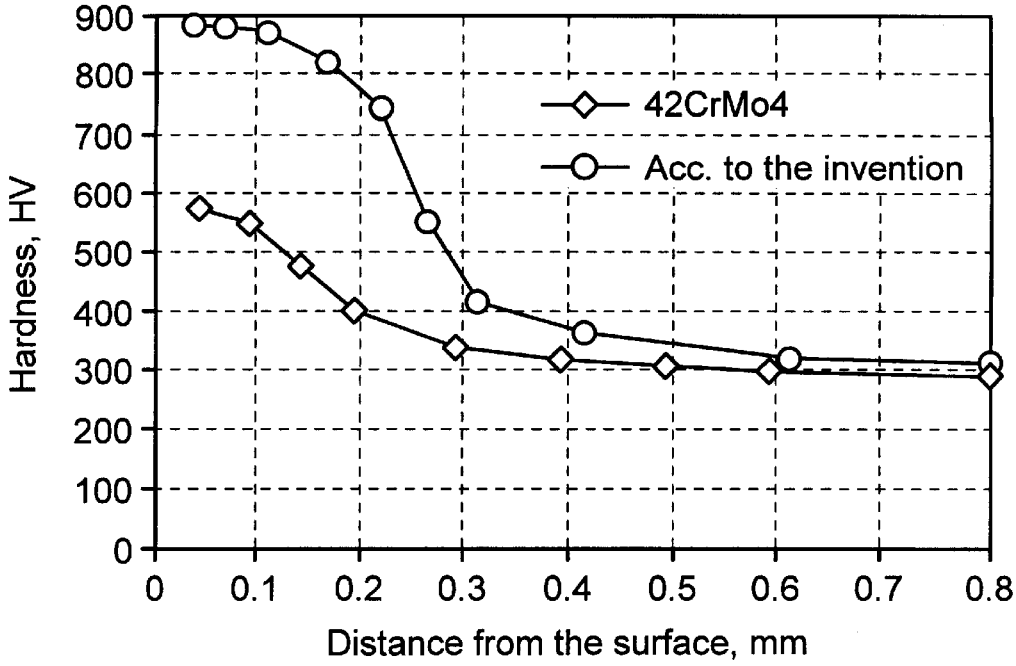
FIG. 1 is a diagram showing the result of plasma nitriding at 510° C., 12 h/530° C., 24 h for the steel 42CrAlMo4 and the steel according to the presently claimed invention, respectively.

In the diagram in FIG. 1, the hardness, HV, is illustrated as a function of the distance from the surface, in mm, for the steel 42CrMo4 compared to the steel according to the presently claimed invention, with compositions lying within the following ranges:

| Presently Claimed Invention | 42CrMo4 |
|---|---|
| C 0.15–0.18 | C 0.38–0.45 |
| Si 0.20–0.40 | Si ≦0.40 |
| Mn 0.75–1.00 | Mn 0.60–0.90 |
| Cr 1.75–2.00 | P ≦0.035 |
| Mo 0.50–0.60 | S ≦0.03 |
| Al 0.010–0.030 | Cr 0.90–1.20 |
| remainder Fe + normal impurities | Mo 0.15–.030 |

The two steels are plasma nitrided at 510° C., 12 h/530° C., 24 h.

From the results illustrated in the diagram, it is clear that adjacent to the surface, a substantially higher hardness is obtained as well as a greater nitriding depth for the steel according to the presently claimed invention.

Figure 2:
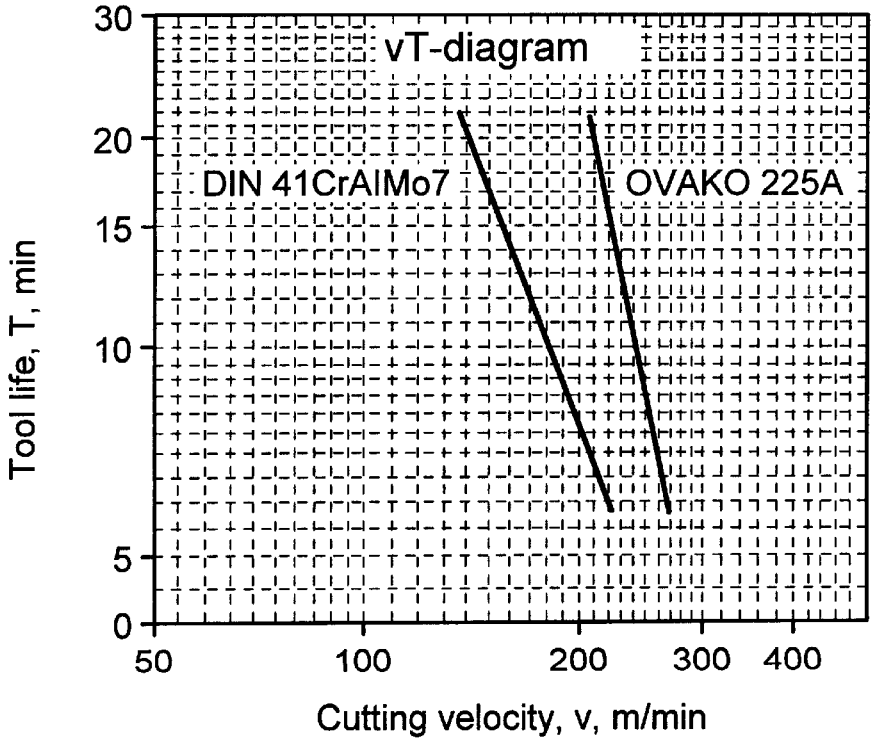
FIG. 2 is a diagram illustrating the workability of the steel 41CrAlMo7 and the steel according to the presently claimed invention, respectively.

In FIG. 2, a vT-diagram is shown, where the tool life T, expressed in minutes, has been plotted versus the cutting velocity v, in m/min, in hard metal turning according to ISO 3685; hardened and annealed material, hardness 280 HB. The steel 41CrAlMo7 is compared with the steel according to the presently claimed invention with a composition within the following ranges:

| Present Invention (OVAKO 225A) | 41CrAlMo7 |
|---|---|
| C 0.15–0.18 | C 0.38–0.45 |
| Si 0.20–0.40 | Si ≦0.40 |
| Mn 0.75–1.00 | Mn 0.50–0.80 |
| Cr 1.75–2.00 | P ≦0.030 |
| Mo 0.50–0.60 | S ≦0.035 |
| A1 0.010–0.030 | Cr 1.50–1.80 |
| remainder Fe + normal impurities | Mo 0.25–0.40 |
| | Al 0.80–1.20 |

As the diagram shows, a substantially improved life is obtained with the steel according to the presently claimed invention. At a cutting velocity of 200 m/min, the tool life is at least 3 times as long compared with said reference steel.

Figure 3:
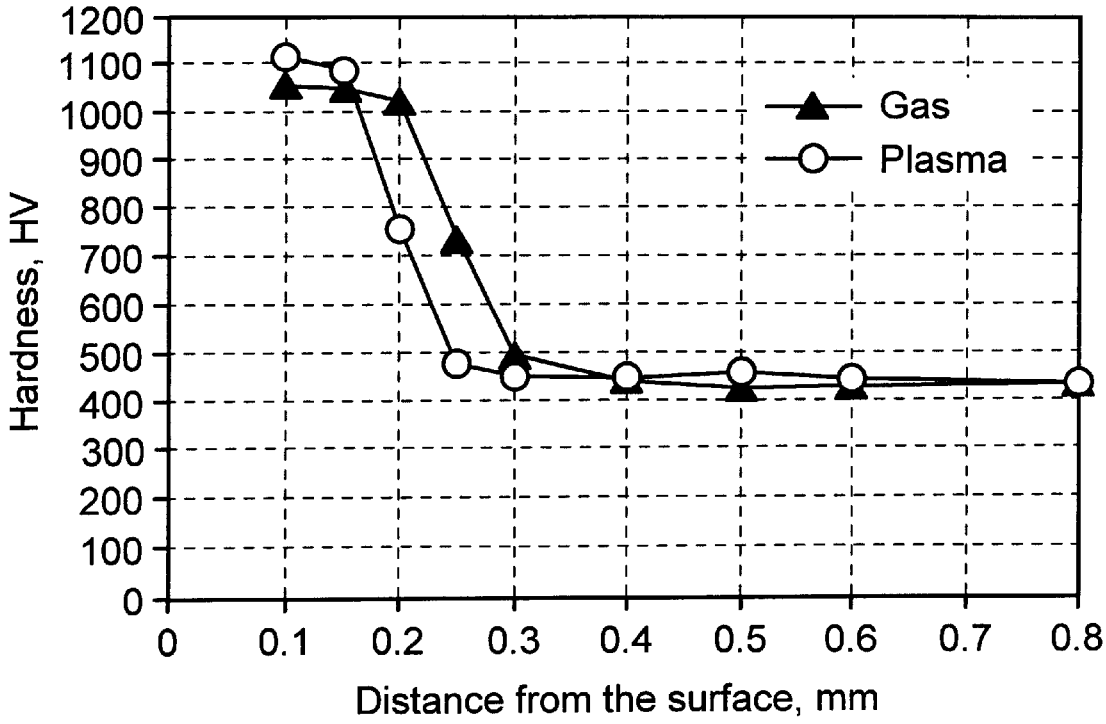
FIG. 3 is a diagram showing the result of gas nitriding at 510° C., 30 h plasma nitriding 480° C., 30 h of a steel according to the presently claimed invention.

The diagram in FIG. 3 illustrates in a manner similar to FIG. 1, the hardness, HV, as a function of the distance from the surface, in mm, for a slightly modified steel having the following composition:

C 0.16

Si 0.24

Mn 0.76

Cr 3.90

Mo 0.60

Al 0.31 remainder Fe+normal impurities

The steel has been subjected to gas nitriding at 510° C., 30 h and to plasma nitriding at 480° C., 30 h, resp.

From the results illustrated in the diagram it is clear that adjacent to the surface, a higher hardness is obtained even as compared to the steel according to the presently claimed invention illustrated in FIG. 1. The higher hardness is an effect of the higher Al and Cr contents. However, the higher Al content results in impaired cutting properties, as compared to the OVAKO 225A illustrated in FIG. 2. A corresponding vT-diagram for the steel according to FIG. 3, would lay between the two steels illustrated in FIG. 3.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A nitriding steel, especially for the manufacture of structural components subjected to wear, consisting essentially of, in % by weight:

C 0.10–0.20

Si ≦0.50

Mn 0.65–1.20

Cr 1.50–4.00

Mo 0.40–0.70

Al ≦0.50

Fe+normal impurities.

2. A steel according to claim 1, having a Al content is greater than 0.0 and less than or equal to 0.50% by weight.

3. The steel of claim 1, comprising, in % by weight:

C 0.15–0.20

Si 0.20–0.40

Mn 0.75–1.00

Cr 1.50–2.50

Mo 0.50–0.65

Al 0.010–0.10 remainder Fe+normal impurities.

4. The steel of claim 1, comprising, in % by weight:

C 0.10–0.18

Si 0.20–0.40

Mn 0.75–1.00

Cr 2.50–4.00

Mo 0.50–0.65

Al 0.10–0.35 remainder Fe+normal impurities.

5. The steel of claim 2, comprising, in % by weight:

C 0.15–0.20

Si 0.20–0.40

Mn 0.75–1.00

Cr 1.50–2.50

Mo 0.50–0.65

Al ≦0.10 remainder Fe+normal impurities.

6. The steel of claim 2, comprising, in % by weight:

C 0.10–0.18

Si 0.20–0.40

Mn 0.75–1.00

Cr 2.50–4.00

Mo 0.50–0.65

Al ≦0.35 remainder Fe+normal impurities.

7. A nitriding steel, especially for the manufacture of structural components subjected to wear, consisting essentially of, in % by weight:

C 0.10–0.20

Si ≦0.50

Mn 0.65–1.20

Cr 1.50–4.00

Mo 0.40–0.70

Al >0.0 and ≦0.50 remainder Fe+normal impurities.

* * * * *